United States Patent [19]

Williams

[11] Patent Number: 4,570,688

[45] Date of Patent: Feb. 18, 1986

[54] SECURITY WALLET

[75] Inventor: George Williams, Greenville, N.C.

[73] Assignee: Brigade Quartermasters, Ltd., Atlanta, Ga.

[21] Appl. No.: 529,022

[22] Filed: Sep. 1, 1983

[51] Int. Cl.[4] ..... A45C 1/06; A45C 13/30

[52] U.S. Cl. ..... 150/134; 150/102; 224/205

[58] Field of Search ..... 150/100, 102, 106–108, 150/110, 112, 118, 131, 132, 134, 135, 136, 140, 143, 145, 147, 28 R, 33–35, 40, 42; 224/202, 205, 902; 383/4, 6, 86

[56] References Cited

U.S. PATENT DOCUMENTS

| | | | |
|---|---|---|---|
| 453,823 | 6/1891 | Weidemann | 150/112 X |
| 754,207 | 3/1904 | Edgar | 150/106 X |
| 811,215 | 1/1906 | Goldsmith | 150/108 |
| 814,205 | 3/1906 | Hawes . | |
| 952,375 | 3/1910 | Stanley | 383/86 X |
| 1,182,580 | 5/1916 | Maxfield | 224/205 |
| 1,214,282 | 1/1917 | Day | 383/86 X |
| 1,370,636 | 3/1921 | Dwyer | 383/86 X |
| 1,816,248 | 7/1931 | Hughes | 150/134 X |
| 2,527,059 | 10/1950 | DiMezza | 150/143 X |
| 2,788,040 | 4/1957 | Hullweck | 150/110 |
| 3,165,135 | 1/1965 | Mintzes et al. | 150/136 X |
| 3,387,641 | 6/1968 | Osborne . | |
| 3,529,649 | 9/1970 | Bennett | 383/11 X |
| 3,545,659 | 12/1970 | Libby | 150/108 |
| 3,622,056 | 11/1971 | Droeger | 383/6 X |
| 3,813,017 | 5/1974 | Pimsleur | 224/901 X |
| 4,079,767 | 3/1978 | Howard | 224/901 X |
| 4,119,249 | 10/1978 | Hanson | 224/901 X |
| 4,126,168 | 11/1978 | Ganz et al. . | |
| 4,177,909 | 12/1979 | Haskell | 150/100 X |
| 4,209,048 | 6/1980 | Sandos | 150/132 |
| 4,316,492 | 2/1982 | Plough et al. | 150/143 |
| 4,332,338 | 6/1982 | Christiansen | 150/143 |

FOREIGN PATENT DOCUMENTS

| | | | |
|---|---|---|---|
| 45236 | 2/1982 | European Pat. Off. | 150/117 |
| 2510879 | 2/1983 | France | 150/35 |
| 124092 | 3/1919 | United Kingdom | 150/143 |

*Primary Examiner*—William Price
*Assistant Examiner*—Sue A. Weaver
*Attorney, Agent, or Firm*—Jones & Askew

[57] ABSTRACT

A foldable wallet intended to be secured on or about the user's person, by means of a cord. The wallet is made of various panels peripherally secured to each other, and defining a number of separate pockets for receiving and storing articles such as passports, maps, paper money, and coins, as well as relatively narrow elongate articles such as pens, penlights, or the like. The mouths of the pockets are transverse to the longitudinal dimension of the wallet, so that the pocket mouths face upwardly to contain articles within the pockets as the wallet is carried by its cord. The wallet folds asymmetrically on its length so that a part of the longer portion remains uncovered, and a pocket may be on the uncovered portion for access without opening the wallet.

13 Claims, 7 Drawing Figures

SECURITY WALLET

FIELD OF THE INVENTION

This invention relates in general to wallets or the like, and relates in particular to wallets for securely and comfortably carrying money or other articles on one's person.

BACKGROUND OF THE INVENTION

Most persons habitually carry on their person a wallet of conventional design, containing paper money and various articles such as personal identification, credit cards, or the like. Conventional wallets usually are carried by men in their hip pocket or inside pocket of a jacket, and by women in a handbag or other separate conveyance which in turn is supported by a hand or shoulder strap. For both men and women, the risk of losing the wallet and its contents to pickpockets or other thieves needs no explanation, and the shock of discovering a missing wallet is compounded by the embarrassment and inconvenience of suddenly losing one's money, credit cards, and the like.

These problems are bad enough for anyone, but they may be particularly troublesome for active persons such as hikers, campers, cyclists, and the like who may be traveling light, or who simply may not want to burden themselves with carrying bulky pocket wallets or conspicuous, burdensome handbags. Moreover, the traveler in a foreign country probably will be carrying essential items such as a passport or personal medication, which may be difficult or impossible to replace on short notice, in addition to customary items such as paper money, coins, or credit cards. The conventional wallet is not well-suited for this purpose, as it cannot comfortably or readily contain outsized or nonfoldable articles such as passports, maps, pens, lipsticks, penlights, or other articles a traveler might desire to keep readily at hand.

SUMMARY OF INVENTION

Stated in general terms, security wallets according to the present invention are substantially flat and flexible whether open or closed, and are intended to be suspended from an elongated cord worn over the users's neck or shoulder, or otherwise secured to a person's belt or the like in a manner which keeps the wallet and its contents relatively accessible yet prevents loss or surreptitious removal of the wallet. The wallet contains a number of pockets extending along the length of the wallet, each pocket having an opening extending transversely across the width of the wallet for inserting or removing articles. At least some of the pockets may be separately closable to securely retain the contents. Furthermore, the entire wallet is foldable so as to enclose at least some of the pockets, yet is capable of leaving a pocket exposed for access without opening the wallet. When folded, the present wallet presents a substantially smooth, flat configuration which is readily concealable beneath a person's shirt or jacket, for freedom of movement and easy access to the wallet and its contents.

Stated somewhat more particularly, the present wallet is made of a number of flat flexible panels which overlie one another to define pockets between various panels. The panels also define a lateral fold line which divides the longitudinal dimension of the wallet into two portions preferably of unequal length. The mouths of the pockets defined in the wallet terminate facing the fold line, so that the pocket mouths are enclosed whenever the wallet is folded shut. Furthermore, the individual pockets may be equipped with closures which keep the particular pocket and its contents secure even while the wallet is in its unfolded and open configuration.

With the preferred asymmetrical location for the fold line of the present wallet, part of the longer wallet portion remains exposed even when folded. A separate pocket may be provided on this exposed portion, the mouth of this pocket being accessible even when the wallet is folded. Other pockets may be provided for receiving relatively narrow elongated articles such as pens or the like. The security wallet preferably includes an elongated carrying cord which may be used as a neck strap to suspend the wallet under a shirt or jacket. Alternatively, the sling cord can be used to secure the wallet at a person's waist, ankle, or elsewhere on the body. The sling cord allows the wallet to hang downwardly in particular orientation so that all pockets of the wallet face upwardly when the wallet thus is suspended, further insuring that loose articles cannot be lost from the wallet.

Accordingly, it is an object of the present invention to provide an improved wallet.

It is another object of the present invention to provide a wallet especially useful for carrying articles in a relatively secure manner.

It is still another object of the present invention to provide a wallet which may contain various pockets or compartments for receiving articles, yet which is relatively compact and may readily be carried in concealment on a person's body.

Other objects and advantages of the present invention will become more readily apparent from the following description of preferred embodiments.

DESCRIPTION OF PREFERRED EMBODIMENTS

Figure 3:
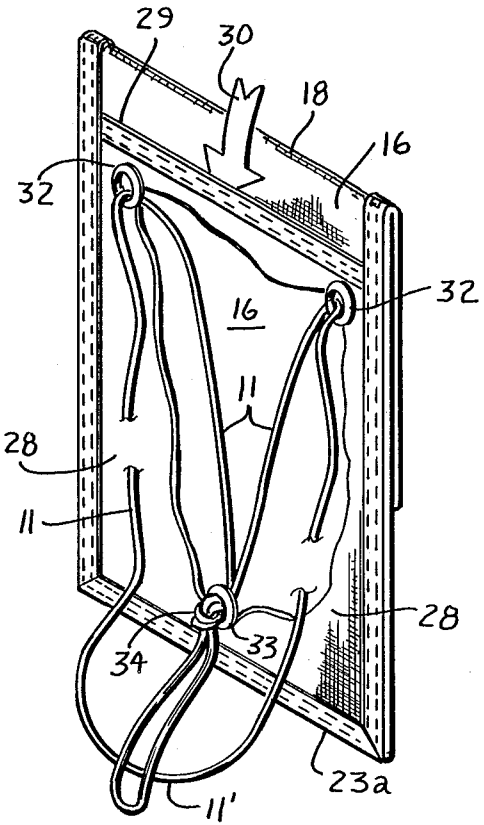
FIG. 3 is a pictorial view showing the back of the wallet in FIG. 2, the wallet shown partially broken away for illustrative purposes.
Figure 2:
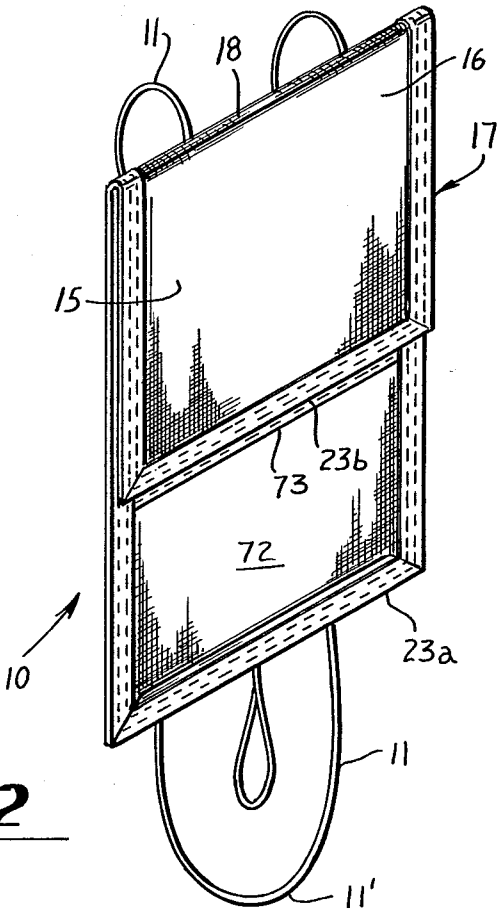
FIG. 2 is a pictorial view in enlarged scale, showing the front of the folded wallet shown in FIG. 1.
Figure 1:
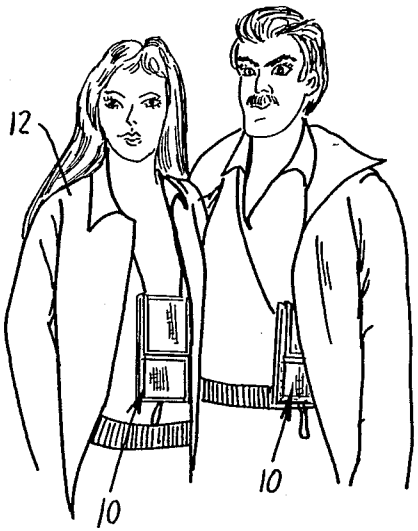
FIG. 1 is a pictorial view showing persons each carrying a wallet according to a preferred embodiment of the present invention.

Turning first to FIGS. 1–3, there are shown generally at 10 two security wallets according to a preferred first embodiment of the present invention. Each wallet 10 is shown in FIG. 1 slung around the neck of a person, the wallet being suspended by the cord 11 which maintains the wallet in a predetermined upright position lying flat against the wearer's body. It will be apparent that the wallet 10 thus may be concealed beneath a person's coat or jacket 12. It will also be apparent that the wallet 10 alternatively may be slipped under the wearer's shirt if desired for maximum security, in which case only the upper end of the cord 11 around the person's neck would be visible. The wallet 10 as thus worn in FIG. 1 is readily accessible by the wearer, yet is easily concealed on the wearer's body if desired. Moreover, with the wallet 10 suspended from the wearer's neck by the elongated cord 11, surreptitious undetected thievery of the wallet becomes extremely difficult. Moreover, as will become apparent, the wallet 10 as carried in the position shown in FIG. 1 is readily accessible, either to remove any contents of the wallet or to display identification papers or the like within the wallet.

Figure 4:
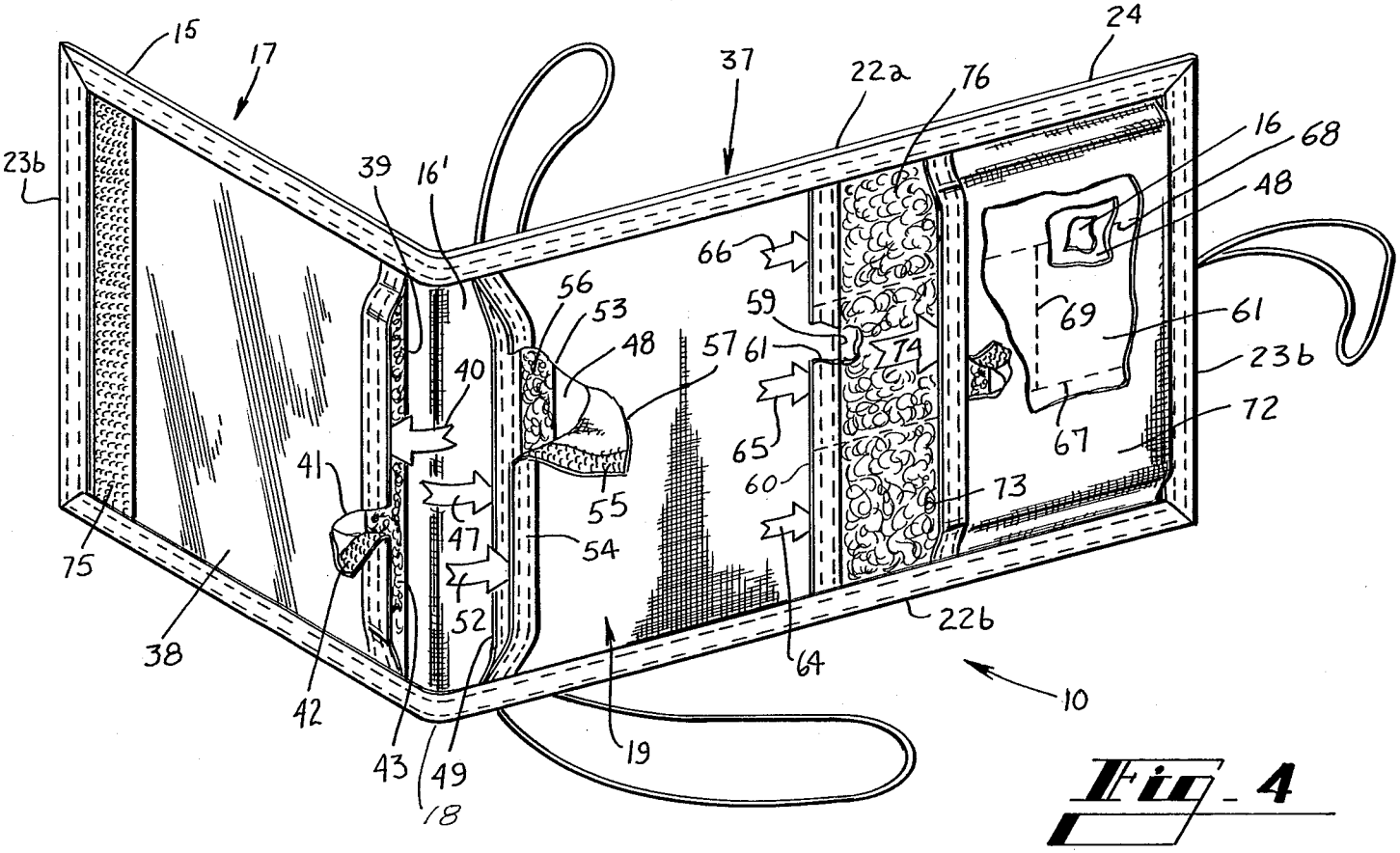
FIG. 4 is a pictorial view showing the wallet of FIGS. 1–3 opened along the fold line, the wallet being shown in an exaggerated folded-back attitude and with portions shown broken away for illustrative purposes.

Turning to FIGS. 2–4, the wallet 10 has an outer side 15 formed by an elongated outer panel 16 extending the full length of the wallet. Approximately one-third of this outer panel 16 is visible in FIG. 2 on the outside of the folded shorter portion 17 of the wallet; portions of the outer panel also are seen immediately below the fold 18 of the wallet in FIG. 3, and in FIG. 4 at the innermost of the broken-away regions at the right side of that figure. The outer panel 16 may be a single-ply material, or alternatively may be a double-ply panel to provide a suitable inner liner at 16' (FIG. 4) while presenting a relatively more durable or appealing appearance on the outer side 15 of the wallet. The panel 16 and other panels of the wallet may be made of suitable durable and water repellant materials such as nylon pack cloth or the like.

The wallet 10 further comprises several other panels which, in the disclosed embodiment, all are shorter in varying degrees than the outer panel 16. These shorter panels define various pockets on the outer side 15 and the inner side 19, FIG. 4, of the wallet 10. However, all panels preferably are substantially the same width as the outer panel 16, and the panels are joined together along the longitudinal peripheral sides **22*a* and 22*b* of the wallet. Moreover, the overlying peripheral ends of the several panels at the longitudinal ends 23*a* and 23*b* of the wallet likewise are joined together. The peripheral edges of the panels making up the wallet 10 may be joined by any suitable technique which provides a strong and durable joint; a preferred technique is the use of double-stitching through lengths of bias tape 24** folded over the peripheral edges of the panels.

Turning to FIG. 3, one such additional panel is shown at 28, extending upwardly from the lower end **23*a* of the wallet to a terminal end 29 spaced a short distance below the fold region 18 of the wallet. The terminal end 29 of the panel 28 is not secured to the outer panel 16, and so the panel 28 thus defines an outside pocket 30** indicated by the access arrow bearing that numeral.

A pair of grommets 32 surround holes through the panel 28 near the terminal upper end 29, these two grommets being relatively widely spaced apart along the width of that panel. A third grommet 33 surrounds a hole located midway across the width of the panel 28, adjacent the lower end **23*a* of the wallet. The previously-mentioned cord 11 extends through the two upper grommets 32, and then downwardly within the pocket 30 to re-emerge through the lower grommet 33 in the panel 28. The cord 11 is knotted at 34 outside the lower grommet 33, to prevent the cord from pulling inwardly through that grommet. By adjusting the placement of the knot 34 on the cord 11, the length of the cord neck-engaging loop 11' thus is adjusted. Referring back to FIG. 1**, it will be seen that this adjustment of the cord loop enables persons of differing heights or body builds to select the cord loop length for comfort and ease of carrying the wallet.

Turning now to FIG. 4, the wallet 10 is seen to include the relatively shorter portion 17 and the relatively longer portion 37 defined by the fold region 18. In the present embodiment 10 of the security wallet the fold region is asymmetrically located along the longitudinal dimension of the wallet, so that the shorter portion 17 is approximately four and one-half inches long and the longer portion 37 is approximately eight inches long, for example. The fold region 18 is defined by certain additional panel members secured to the outer panel 16 along the inner side 19 thereof as described below, whereby the inside of the fold region 18 consists only of the outer panel 16 and thus is relatively more flexible than the multiple-panel portions confronting the fold region 18 on the shorter portion 17 and longer portion 37 of the wallet.

One such additional panel is the transparent window panel 38, peripherally secured on the inside of the wallet shorter portion 17. The window panel 38 is made of any suitable transparent material such as clear vinyl plastic or the like, and has a terminal end 39 unattached to the underlying panel 16 and extending laterally across the width of the wallet 10 to confront the fold region 18. This terminal end 39 thus defines the mouth of a pocket 40, advantageously for containing identification documents such as a driver's license or the like. As illustrated at the tearaway depiction 41, the terminal end 39 of the pocket 40 preferably is lined on the underside with a fastening strip 42 of suitable material such as complementary hook-and-pile material, known by the trademark Velcro. A strip 43 of complementary fastening material is affixed to the inner side of the wallet immediately beneath the strip 42. The unattached terminal end 39 of the pocket 40 thus may be secured closed by the complementary hook-and-pile fastener 42, 43 to protect the contents of this pocket.

Turning now to the relatively longer portion 37 of the wallet, a first inside pocket denoted by the access arrow 47 is defined by the panel member 48, having an unattached terminal end 49 extending laterally across the inside surface of the outer panel 16 adjacent the fold region 18. The panel 48 extends longitudinally to the lower end **23*a* of the wallet 10, and is secured to the outer panel 16 at that lower end and also along the side peripheral edges 22*a* and 22*b*. The resulting pocket 47 defined by the panel 48 thus is substantially coextensive in length with the longer portion 37 of the wallet 10**, and this pocket is particularly useful for stowing relatively outsized articles such as maps, a passport, or the like.

Another inside pocket 52, being of shorter length in the disclosed embodiment than the pocket 47, is defined by the panel 53 which overlies the panel 48 and has an unattached terminal end 54 defining the mouth of the pocket 52. The terminal end 54 extends across the full width of the wallet in confronting relation to the fold region 18, and is seen substantially to overlie the terminal end 49 of the pocket 47. The mouths of the two pockets 47 and 52 thus are contiguous one below the other, and together these mouths confront the mouth of the pocket 40 across the fold region 18 of the wallet.

A strip 55 of hook-and-pile fastening material is present along the underside of the terminal end 54 for the panel 53 as shown in the tearaway depiction 57, and a subjacent strip 56 of complementary fastening material extends laterally across the confronting outside surface of the panel 48.

The pocket 52 defined by the panel 53 terminates at the bottom end 59 of that panel, concealed beneath the terminal end 60 of another panel 61 extending laterally across the width of the wallet. The length of the panel 61 in the disclosed embodiment 10 is fractionally more than one-half the length of the longer portion 37; and so the depth of the pocket 52, whose bottom end 59 is stitched to the underlying panel 48 a short distance below the upper terminal end 60 of the panel 61, is approximately one-half the length of the longer portion 37.

Three relatively narrow pockets 64, 65, and 66, defined between the panel 48 and the panel 61, are disposed alongside each other across the width of the wallet 10. The two parallel lines of longitudinal stitching 67 and 68, shown in the cutaway regions of FIG. 4, define the inner sides of the pockets 64, 66 and both sides of the middle pocket 65. The pockets 64 and 66 extend substantially the full length of the panel 61, and these pockets are particularly useful for receiving elongated articles such as pens, penlights, or the like. The bottom of the middle pocket 65 is defined by the line of transverse stitching 69 connecting the stitching lines 67, 68, making this middle pocket relatively more shallow than the two flanking pockets 64, 66. The transverse stitching 69 in the disclosed embodiment is located so that the depth of pocket 65 is approximately one-half that of the flanking pockets 64, 66; the pocket 65 thus is particularly suited for holding relatively shorter elongated articles such as lipsticks, keys, or other articles.

Disposed along part of the length of the panel 61 is the outermost panel 72 located on the inner side of the wallet 10. The panel 72 extends laterally the full width of the wallet, and has an upwardly-facing terminal end 73 unattached to the underlying panel 61. A layer of complementary hook-and-pile fastening material may be provided on the underside of the terminal end 73. As best seen in FIG. 2, the length of the panel 72 is chosen so that the upwardly-facing terminal end 73 of that panel is substantially aligned in close confronting relation with the upper end **23*b* of the wallet 10, when the shorter portion 17 is folded over to close the wallet as shown in FIG. 2. The pocket 74 defined by the panel 72 thus remains accessible while the wallet is closed. This arrangement provides a relatively flat, compact configuration when the wallet is folded, and also allows all inner pockets 40, 47, 52, 64, 65, and 66 to be covered by the folded-over shorter portion 17** of the wallet.

A band 75 of complementary hook-and-pile fastener material is affixed to the shorter portion 17 of the wallet on the inner side thereof adjacent the upper end **23*b*, as best seen in FIG. 4. This band 75 engages a band 76 of complementary fastening material, extending across the width of the longer portion 37 at a longitudinal location to insure overlap when the shorter portion 17 is folded as shown in FIG. 2. The longitudinal extent of the fastening material 76 along the length of the longer portion 37 preferably is sufficient to accommodate some variation in the folded-over location of the shorter portion 17, allowing the wallet to be secured when folded to enclose contents of various bulk. The fastening material strip 76 also provides complementary engagement for the fastening strip mounted on the underside of the terminal end 73 for the outermost panel 72**, as previously described.

It should now be apparent that the wallet 10 provides a selection of pockets for containing different kinds of articles which a traveler might desire to carry. The pocket 40 with the transparent window panel 38 is useful for carrying identification, transit passes, or other documentation which must be displayed by the user from time to time. The longest inner pocket 47 is particularly useful for carrying relatively lengthy or thick articles such as maps, passports, or the like. The middle inner pocket 52 may be particularly desired for carrying valuables such as paper money or traveler's checks, inasmuch as this pocket can be secured against opening even while the wallet itself is open.

The pocket 74 also is separately securable and may be useful for carrying loose change, transit tokens, or other items of some value. This pocket 74 is easily accessible even without opening the shorter portion 17 of the wallet, permitting coins or other articles to be added or removed from the pocket without otherwise disturbing the wallets 10 or its contents.

The first-described pocket 30, on the outside of the wallet, can be useful for various articles such as maps or transit schedules, keeping these articles close at hand and readily accessible without unfolding the wallet or opening a secured pocket of the wallet. As previously mentioned, the relatively narrow pockets 64–66 are particularly useful for retaining elongated articles of various length, in readily-accessible locations.

Figure 6:
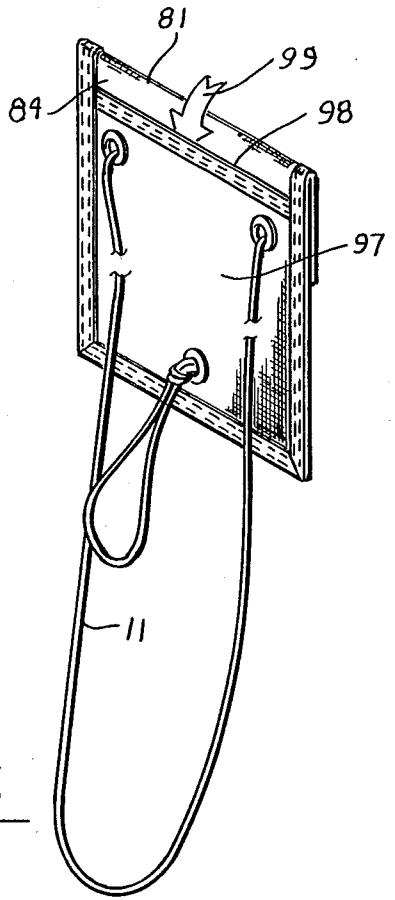
FIG. 6 is a pictorial view showing the back of the wallet in FIG. 5.
Figure 7:
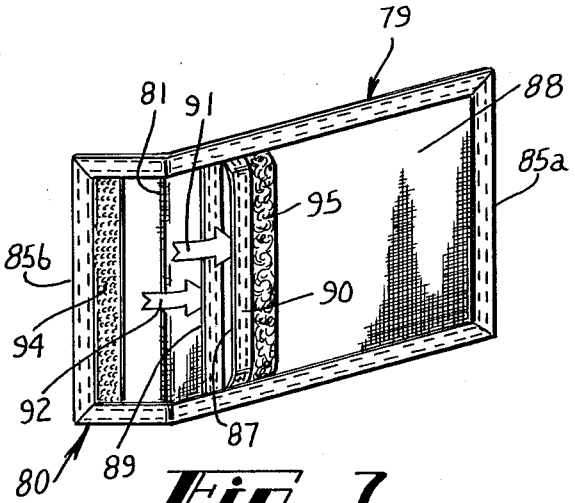
FIG. 7 is a pictorial view showing the wallet of FIGS. 5 and 6 in open position.
Figure 5:
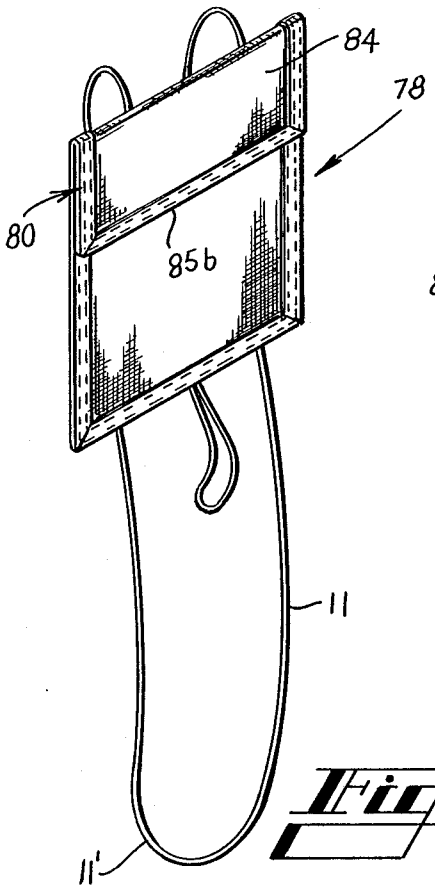
FIG. 5 is a pictorial view showing the front of a wallet according to a preferred second embodiment of the present invention.

Turning now to FIGS. 5–7, there is shown a wallet 78 according to another embodiment of the invention. The wallet 78 is relatively smaller and less expensive than the wallet 10 previously described, and offers a lesser number and variety of pockets. Nonetheless, the wallet 78 provides substantially the same security features of the wallet 10, including the cord 11 with the neck loop 11' which enables the wallet 78 to be carried on a person's body in concealment under clothing or the like.

The wallet 78 has the same overall configuration as the wallet 10, including a longer portion 79 and a shorter portion 80 defined around a transversely-extending fold region 81. The wallet 79 includes an outer panel 84 having a lower end **85*a*, and an upper end 85*b* which also forms the lower edge of the shorter portion 80 when in the folded configuration shown in FIG. 5**.

On the inner side of the longer portion 79 are a pair of panels 87 and 88, having respective upwardly-facing terminal ends 89 and 90 facing the fold region 81. The terminal end 90 of the outermost inner panel 88 is stepped downwardly to be slightly below the terminal end 89, as best seen in FIG. 7, so that the mouths of the respective pockets 91 and 92 are separately defined and easily accessible. The bottom ends of both panels 87 and 88 terminate at the bottom end **85*a* of the wallet 79. Strips of complementary fastening material 94 and 95 are affixed to the underside of the wallet shorter portion 80 and to the panel 88 immediately below the terminal end 87, respectively, to secure the shorter portion in the folded position, FIG. 5, covering the mouths of the two pockets 91 and 92**.

Turning to FIG. 6, another panel 97 having an unattached upper terminal end 98 is affixed to the outer side of the outer panel 84. The upwardly-facing terminal end of the panel 97 ends just below the fold line 81 of the wallet 78, providing a pocket 99 on the outside of the wallet. The cord 11 is secured through grommets in the panel 97, in the manner previously described above.

It should be understood that the foregoing relates to disclosed embodiments of the present invention, and that numerous changes and modifications may be made therein without departing from the spirit and scope of the invention as defined in the following claims.

I claim:

1. A foldable security wallet, comprising:

first flat panel means having a first side facing an outer side of the wallet and an inside surface facing an inner side of the wallet, and having a longitudinal dimension extending substantially the length of the wallet;

second flat panel means having peripheral edges overlying and peripherally secured to said inside surface of said first panel means to define a first article-receiving pocket;

said second panel means extending from one end of said first panel means to a terminal edge at an asymmetrical location along said longitudinal dimension and dividing the first panel means into a shorter portion and a longer portion, said terminal edge extending across the width of said first panel means and being unattached to said inside surface of said first panel means so as to form the mouth of said pocket, whereby the length of said first pocket is parallel to the longitudinal dimension of said first panel means;

means defining a fold region extending laterally across said first panel means adjacent said mouth of the pocket, the shorter portion of said first panel means being selectably foldable to overlay the longer portion of the first panel means and thus to overlay said terminal edge of said second panel means, so as to selectably close the mouth of said first pocket;

third flat panel means having peripheral edges overlying said second panel means to define a second pocket and extending in length susbstantially less than the longitudinal extent of the longer portion of said first panel means, so that the bottom end of the third panel means is spaced inwardly from said one end of the first panel means, said third panel means having an unsecured terminal edge extending across the width of said first panel means to form the mouth of said second pocket;

said terminal edges of said second and third panel means being substantially in mutual alignment, so that the mouths of said first and second pockets are mutually contiguous;

fourth flat panel means having peripheral edges overlying said second panel means between the bottom end of said third panel means and said one end of the first panel means, so as to define a third pocket on said inner side of the wallet;

said fourth panel means having an unattached terminal edge extending across the width of said first panel means adjacent said bottom end of said third panel means to form the mouth of said third pocket; and said peripheral edges of each panel means being secured to confronting peripheral edges of the adjacent panel means, whereby the security wallet presents a substantially smooth and flat configuration whether folded or unfolded.

2. The foldable security wallet as in claim 1, further comprising:

another flat panel means overlying and peripherally secured to said inside surface of said first panel means on the shorter portion thereof to define another article-receiving pocket;

said other panel means having an unattached terminal edge extending across the width of said first panel means so as to form the mouth of said other pocket, the length of said other pocket also being parallel to the longitudinal dimension of said first panel means; and the terminal edges of said second and other panel means confronting each other in closely spaced apart relation so that the gap between the confronting terminal edges defines said fold region, whereby the mouths of said first and said other pockets are inaccessible when said shorter portion of the first panel means is folded.

3. The wallet as in claim 2, further comprising securement means on said second panel means to releasably engage said shorter portion when folded to overlie the larger portion of said first panel means, so that when the wallet is releasably engaged in said folded condition, the mouths of said first and other pockets remain inaccessible while the mouth of said third pocket remains accessible.

4. The wallet as in claim 1, further comprising:

securement means associated with said terminal edge of said third panel means for releasably engaging said second panel means, whereby the mouth of said second pocket can be selectably secured or opened independently of the mouth of said first pocket.

5. The wallet as in claim 1, wherein:

said third panel means and thus said second pocket extend in width substantially coextensive with the width of said first panel means; and said third panel means extends in length substantially less than said second panel means, so that the depth of the second pocket is substantially less than the depth of the first pocket.

6. The wallet as in claim 1, further comprising securement means associated with said terminal edge of said fourth panel for releasably closing said third pocket.

7. The wallet as in claim 1, wherein:

said terminal edge of said fourth panel means is located to remain uncovered by said shorter portion of the first panel means when folded to overlay said longer portion, so that said third pocket remains accessible when said shorter portion is folded to overlay the mouths of said first and second pockets.

8. The wallet as in claim 7, further comprising securement means on said shorter portion to releasably hold the shorter portion in said folded position.

9. The wallet as in claim 7, further comprising:

a first fastening material disposed on said inner side of the wallet adjacent said terminal edge of the fourth panel means;

a quantity of complementary fastening material disposed on said fourth panel means adjacent said terminal edge, so as to contact and releasably engage said first fastening material for closing the mouth of said third pocket; and another quantity of complementary fastening material on the inner side of said shorter portion of the first panel means in position to contact and releasably engage said first fastening material when placed in said folded position, whereby either said shorter portion of the first panel means or the terminal edge of said fourth panel means can selectably engage or release said first fastening material, so as to selectably unfold and open said first panel means or to selectably open said third pocket.

10. The wallet as in claim 9, further comprising:

cord means engaging said outer side of the wallet adjacent said fold region so that said cord means can suspend the wallet with the mouths of said first, second, and third pockets uppermost.

11. The wallet as in claim 9, further comprising:

fifth panel means overlaying and peripherally secured to the first side of said first panel means to define a fourth pocket; and said fifth panel means having a terminal edge extending aross the width of said first panel means adjacent said fold line so as to form the mouth of said fourth pocket, the length of the fourth pocket extending parallel to said longitudinal dimension of the first panel means.

12. The wallet as in claim 11, further comprising:

cord means engaging said fifth panel means adjacent said terminal edge thereof, so that said cord means can suspend the wallet with the mouths of all said pockets uppermost.

13. The wallet as in claim 12, wherein said cord means comprises:

a length of cord extending outwardly from opposite side edges of said fifth panel means at a location proximal to the mouth of said fourth pocket to form a loop for carrying the wallet; and said length of cord extending downwardly behind said fifth panel means and emerging from the fifth panel means at a location distal to the mouth of said fourth pocket;

whereby the size of said loop can be adjusted by drawing said emerging cord downwardly through said fourth pocket.

* * * * *